US009255442B2

(12) United States Patent
Nicolosi

(10) Patent No.: US 9,255,442 B2
(45) Date of Patent: Feb. 9, 2016

(54) DOUBLE GLAZING SYSTEM

(71) Applicant: Pellini S.p.A., Codogno (Lodi) (IT)

(72) Inventor: Giovanni Nicolosi, Codogno (IT)

(73) Assignee: PELLINI S.P.A., Codogno (Lodi) (IT)

( * ) Notice: Subject to any disclaimer, the term of this patent is extended or adjusted under 35 U.S.C. 154(b) by 11 days.

(21) Appl. No.: 14/349,902

(22) PCT Filed: Oct. 5, 2012

(86) PCT No.: PCT/IB2012/055358

§ 371 (c)(1),
(2) Date: Apr. 4, 2014

(87) PCT Pub. No.: WO2013/050969

PCT Pub. Date: Apr. 11, 2013

(65) Prior Publication Data

US 2014/0246155 A1 Sep. 4, 2014

(30) Foreign Application Priority Data

Oct. 5, 2011 (IT) ..... BO2011A0568

(51) Int. Cl.
*E06B 9/264* (2006.01)
*E06B 3/663* (2006.01)
*E06B 3/67* (2006.01)

(52) U.S. Cl.
CPC ..... *E06B 9/264* (2013.01); *E06B 3/66309* (2013.01); *E06B 3/66319* (2013.01); *E06B 3/66328* (2013.01); *E06B 3/6722* (2013.01); *E06B 2003/6638* (2013.01); *E06B 2003/66385* (2013.01); *E06B 2009/2643* (2013.01); *Y10T 29/49826* (2015.01)

(58) Field of Classification Search
USPC ..... 160/107, 98; 52/786.13
IPC ..... E06B 9/264,2009/2643, 3/66328, 3/66352, E06B 3/66361, 2003/6639, 2003/6638
See application file for complete search history.

(56) References Cited

U.S. PATENT DOCUMENTS

| | | | | | |
|---|---|---|---|---|---|
| 2,545,906 | A | * | 3/1951 | Watkins | 359/596 |
| 2,854,102 | A | * | 9/1958 | Peeples | 49/82.1 |
| 3,722,572 | A | * | 3/1973 | Hall | 160/107 |
| 4,459,778 | A | * | 7/1984 | Ball | 49/64 |
| 4,586,289 | A | * | 5/1986 | Jaeger | 49/64 |
| 4,649,980 | A | * | 3/1987 | Kunz | 160/98 |

(Continued)

FOREIGN PATENT DOCUMENTS

| | | |
|---|---|---|
| DE | 10060183 | 6/2002 |
| WO | WO2006000219 | 1/2006 |

*Primary Examiner* — David Purol
(74) *Attorney, Agent, or Firm* — Tutunjian & Bitetto, P.C.

(57) ABSTRACT

A double glazing system, including a first sheet of glass, a second sheet of glass, a spacer element including a first surface for coupling with the first sheet of glass and a second surface for coupling with the second sheet of glass, a blind, or a screen, said spacer element made from low thermally conductive material including rubber and/or silicone foam. The spacer element includes support means including a housing made of a substantially "T"-shaped groove made on a surface perpendicular to the first surface and to the second surface. The support means include two lateral sections for guiding said blind, screen or the like having respective substantially "T"-shaped portions and being able to be engaged in said housing, the lateral sections including respective free ends for supporting respective end portions of said blind, screen or the like.

11 Claims, 4 Drawing Sheets

(56) References Cited

U.S. PATENT DOCUMENTS 4,754,592 A * 7/1988 Moench et al. ..... 52/786.13
5,839,492 A * 11/1998 Young ..... 160/107
7,234,501 B1 6/2007 Park

* cited by examiner

DOUBLE GLAZING SYSTEM

BACKGROUND

1. Technical Field of the Invention

The present invention concerns a double glazing system. More in detail, the present invention concerns a double glazing system equipped with screens and/or blinds, or other similar elements.

2. Description of Related Art

In the field of the production of double glazing systems and the like, one problem that is particularly serious is that of saving energy in the building in which the systems are installed.

In greater detail, it is necessary to reduce, as much as possible, the emissions towards the outside, which indeed occur through the double glazing system.

A double glazing system usually comprises a frame made up of spacer elements—for example made from aluminium, but also from other materials—which are mounted at the sides of the chamber defined between two sheets of glass, indeed for keeping the latter separated from one another and for preventing gas from coming out along the edges.

The spacer elements are also connected to one another with suitable angular elements, or alternatively they can be obtained with a single bent profile.

It is known that in order to obtain good results in terms of energy saving it is necessary to use glass con low emission coating, which are available on the market, and reduce the linear heat transmission value of each of the spacer elements.

On the market it is currently possible to find spacer elements with low linear heat transmission values—known as "warm edge" in the field—which halve such a value if compared with that of the elements made from extruded aluminium.

The aforementioned "warm edge" spacer elements of the known type, however, are usually available on the market having flat or substantially flat shapes, exclusively designed for supporting the double glazing system. In other words, the aforementioned "warm edge" spacer elements do not have the geometry which can be typically obtained in known elements made from extruded aluminium, and therefore do not make it possible to simultaneously act as a support for the double glazing system and for elements such as screens or blinds to be mounted inside them.

SUMMARY OF THE INVENTION

The technical task of the present invention is that of improving the state of the art.

In such a technical task, one purpose of the present invention is to devise a double glazing system comprising a spacer element with low linear heat transmission values and suitable for fixing screens, blinds and the like inside the double glazing.

Yet another purpose of the present invention is that of making a double glazing system comprising a spacer element that can be used for all the sides of the double glazing, reducing storage and optimising costs.

This task and other purposes are achieved with the double glazing system according to the attached claim 1.

The dependent claims refer to preferred and advantageous embodiments of the invention.

BRIEF DESCRIPTION OF THE DRAWINGS

The characteristics of the invention shall become clearer by a man skilled in the art from the following description and from the attached drawing tables, given as an example and not for limiting purposes, in which.

DETAILED DESCRIPTION OF THE INVENTION

Figure 1:
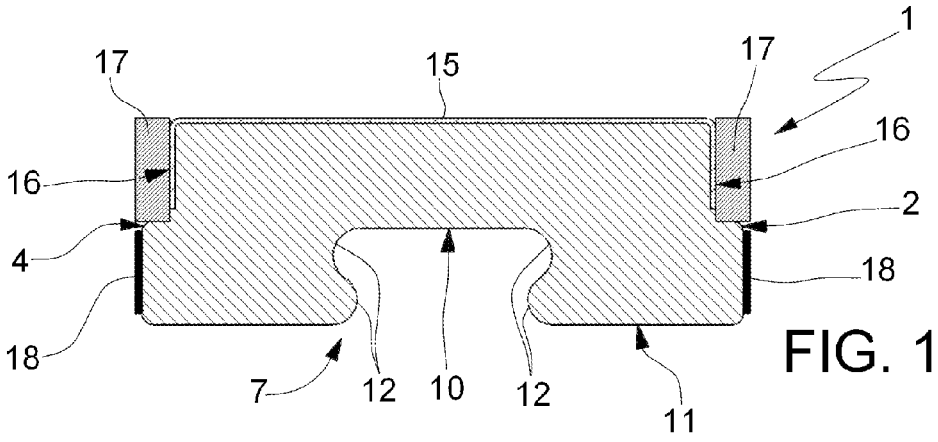
FIG. 1 is a section view of the spacer element of the double glazing system according to the invention.

With reference to the attached FIG. 1, a spacer element of a double glazing system 6 according to the present invention is wholly indicated with reference numeral 1.

The double glazing system 6 according to the invention can be of any type as far as the materials used, the shapes, the dimensions, the field of application, etc. are concerned, without limiting the present invention.

The spacer element 1 of the double glazing system 6 according to the invention is in the form of a section, with a length that is suitable in relation to the dimensions of the double glazing system to be made.

The spacer element 1 comprises a first surface 2 for being coupled with a first sheet of glass 3 and a second surface 4 for being coupled with a second sheet of glass 5.

The first surface 2 and the second surface 4 are parallel to one another.

Figure 3:
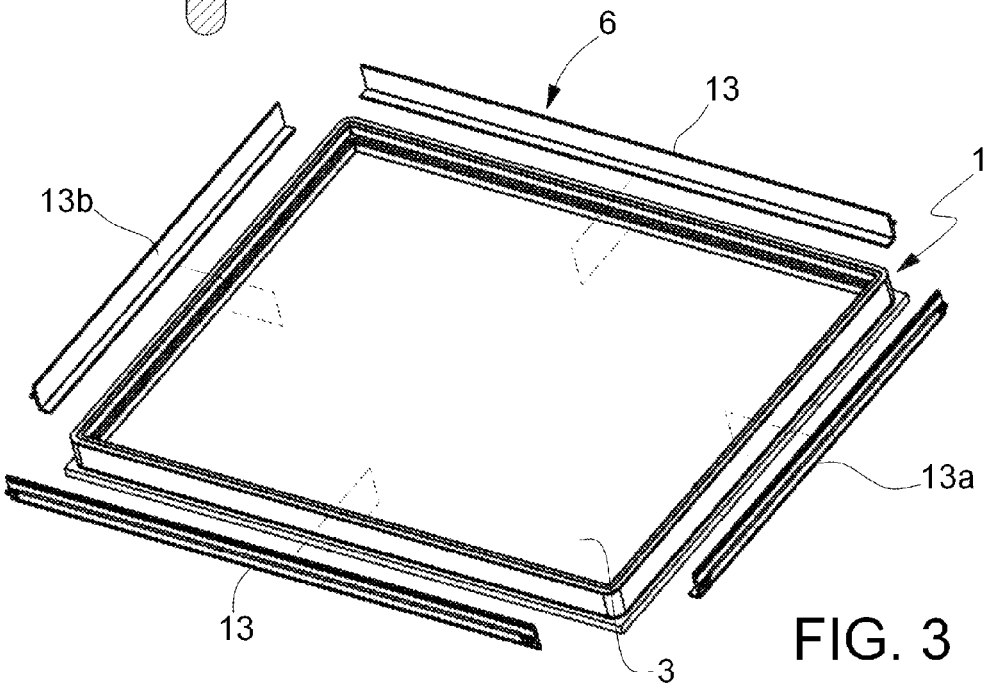
FIG. 3 is an exploded view of a double glazing system according to the invention, with one glass sheet removed.

In order to make the invention clearer, FIG. 3 shows the double glazing system, wholly indicated with reference numeral 6, incorporating the spacer elements 1. In FIG. 3 the second sheet of glass 5 is removed for the sake of clarity, whereas the remaining components are represented exploded.

According to one aspect of the present invention, the spacer element 1 is made with a low thermally conductive material.

In greater detail, the low thermally conductive material comprises rubber, for example natural or synthetic rubber.

In other embodiments, the aforementioned material can comprise silicone foam, and/or the like, or any other material found on the market having analogous properties.

This makes it possible to obtain an object that is characterised by low linear heat transmission values, i.e. so as to reduce emission towards the outside of thermal energy by the double glazing at the peripheral frame, or rather the area in which the spacers are mounted.

According to another aspect of the invention, the spacer element 1 comprises support means, wholly indicated with reference numeral 7, for a blind 8, a screen or the like inside the double glazing, as visible in FIGS. 6-9.

The blind 8, or rather the blind group installed inside the double glazing comprises, in a per se known manner, a support box, indicated with reference numeral 9.

As known, the box 9 of the blind 8 allows it to be fixed inside the double glazing system 6.

The support means 7 comprise a housing 10, foreseen in a surface 11 that is perpendicular to the first surface 2 and to the second surface 4.

In greater detail, the housing 10 of the spacer element is made up of a substantially "T"-shaped groove, made in the surface 11 that is perpendicular to the first surface 2 and to the second surface 4 of the spacer element itself.

The housing 10 of the spacer element 1 is equipped with rounded edges 12. In such a way the possibility of cracks or fractures forming in the material is avoided.

The support means 7 of the spacer element according to the invention also comprise a section 13 for guiding the blind 8, screen or the like.

Figure 2:
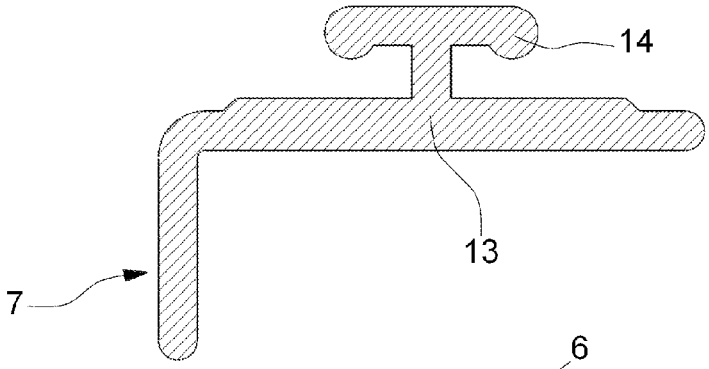
FIG. 2 is a constructive detail of the spacer element.

The guiding section 13, as illustrated in the detail of FIG. 2, comprises a substantially "T"-shaped portion 14, that can be engaged in the housing 10.

The guiding section 13 is substantially "L"-shaped, and its function shall become clearer in the rest of the description.

The guiding section 13 is made from rigid material. For example, it can be made from plastic material such as polypropylene or the like, or again from any other material having characteristics that are suitable for the application.

With reference to FIG. 1, the spacer element 1 according to the present embodiment comprises a multi-layer barrier 15 as a barrier to gas and sealant against vapour, which covers the outer surface of the element 1 itself.

The multi-layer barrier 15 is made according to methods known in the field, and it is for example made from metal material.

The spacer element 1 moreover comprises lateral recesses 16 for containing sealing gaskets 17, generally butyl gaskets, necessary for the assembly of the double glazing system 6.

At the sides of the spacer element 1, moreover, additional adhesive elements 18 can be foreseen.

The spacer element according to the present embodiment comprises, in a per se known manner, drying substances such as salts and the like, enclosed inside it.

FIGS. 3-9 illustrate various details and stages of the assembly of the double glazing system 6 according to the invention.

In particular, FIG. 3 illustrates the double glazing system 6 partially exploded, without the second sheet of glass 5 and without the blind 8, with the guiding sections 13 removed from the spacer element 1 already stuck on the glass.

Figure 8:
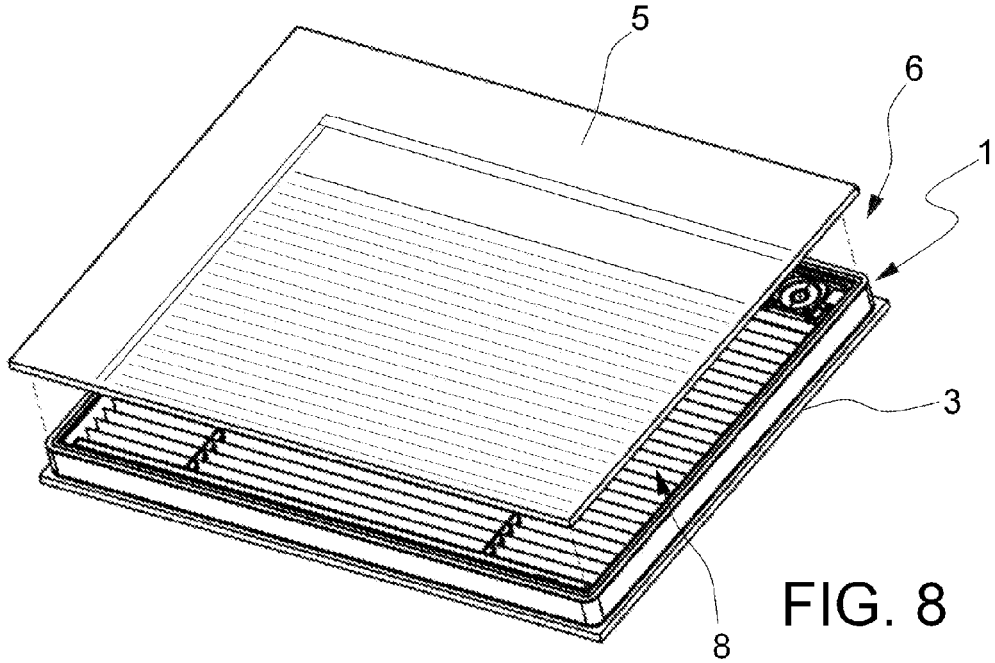
FIG. 8 is an axonometric partially exploded view of the double glazing system according to the invention.

FIG. 8 on the other hand illustrates the assembled double glazing system 6, with a blind 8 mounted inside it and with the second sheet of glass 5 raised for the sake of clarity.

As clearly visible in the aforementioned FIG. 3, the double glazing system 6 is preferably assembled by using a single spacer element 1 closed like a frame.

Alternatively, however, single pieces having a suitable length could be used.

Along the four sides it is foreseen for there to be four guiding sections 13, with the respective "T"-shaped portions 14 engaged in the same housing 10 of the spacer element 1.

The two specific opposite guiding sections 13*a*, 13*b*-indicated in FIG. 3—which must act as lateral guides and supports for the blind 8 once assembled, each comprise a respective free end 19 for supporting a respective end portion 20 of the blind 8, or a screen, or the like.

The upper and lower guiding sections 13, in another embodiment of the invention not represented in the figures, may not be present, since the support function of the blind 8 is only carried out by the lateral guiding sections 13*a*, 13*b*, so as to limit the number of the components used and to thus obtain a more cost-effective solution.

The assembly of the double glazing system 6 according to the present invention using the spacer element 1 is carried out as follows.

In a first stage, the spacer element 1, already provided with adhesive elements 18 and gaskets 17 on both the surfaces 2,4, is fixed, in the known manner, to the first sheet of glass 3 of the double glazing system 6, like in FIG. 3, obtaining a closed frame with a single piece.

Figure 4:
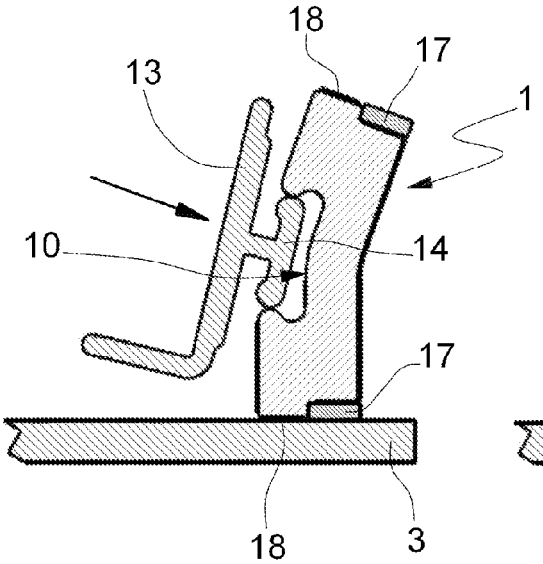
FIGS. 4, 5 are cross section views illustrating subsequent assembly stages of the double glazing system of FIG. 3.
Figure 5:
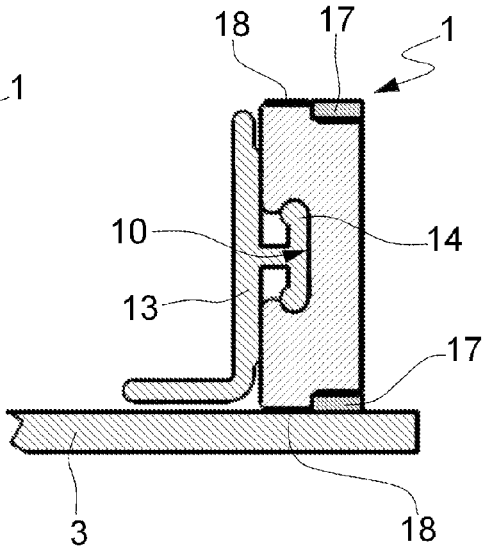

Subsequently, as illustrated in FIGS. 4 and 5, the guiding sections 13, 13*a*, 13*b* are inserted in the housing 10 of the spacer element 1, said housing elastically retaining the "T"-shaped portions 14 of the four guiding sections 13,13*a*,13*b*.

Figure 6:
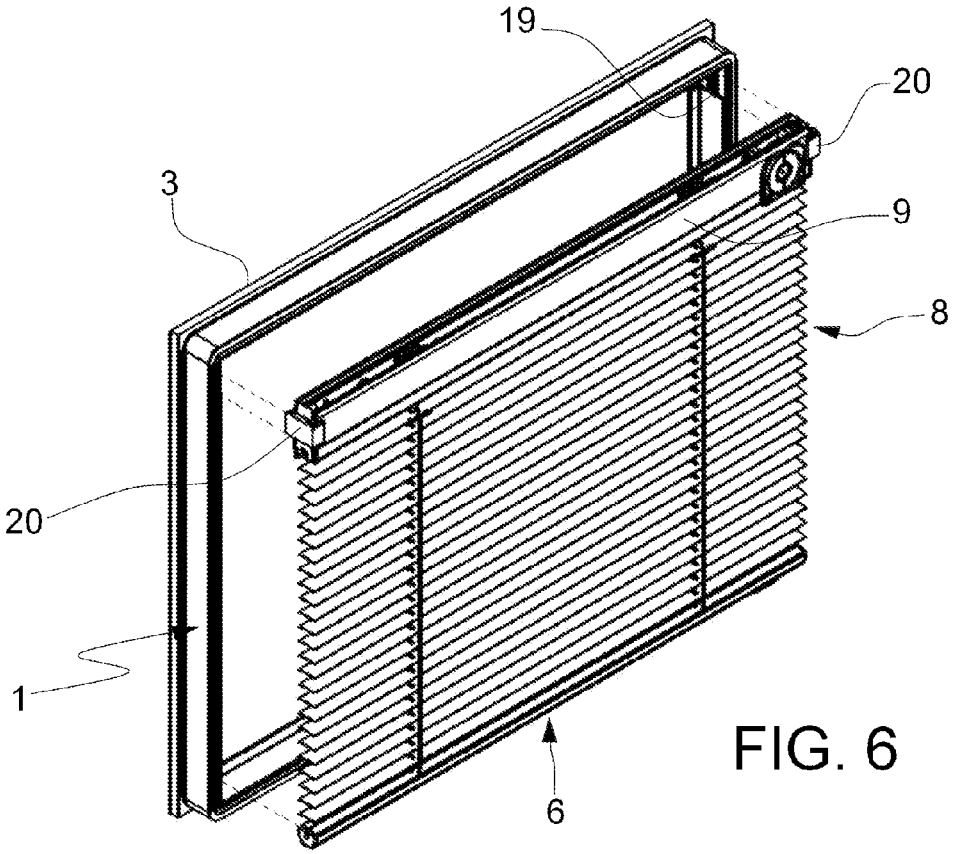
FIG. 6 is an axonometric view of the double glazing system of FIGS. 3, 4, 5, in one assembly stage of a blind.
Figure 7:
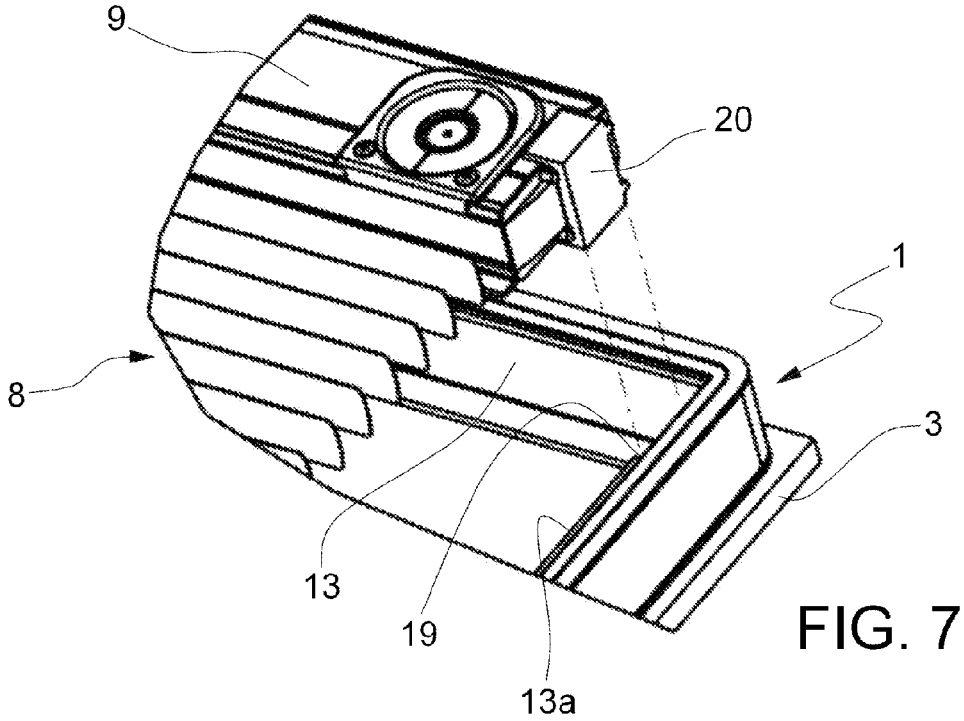
FIG. 7 is a detail of FIG. 6.

After this the blind 8 is mounted, as illustrated in FIGS. 6 and 7, so that the end portions 20 of the blind 8 itself rest on the free ends 19 of the lateral guiding sections 13*a* and 13*b*.

The second sheet of glass 5 is then mounted, thanks to the adhesive elements 18 and to the gaskets 17 present on the spacer element 1.

Figure 9:
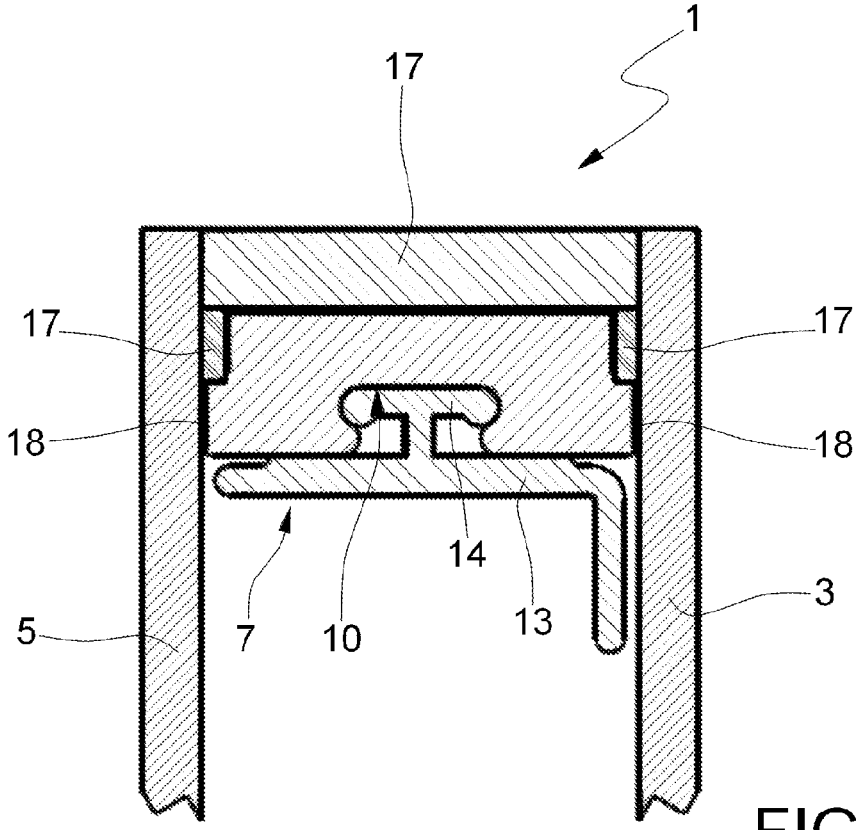
FIG. 9 is a section view of a detail of the assembled double glazing system, according to the invention.

The final assembly of the second sheet of glass 5 locks all the guiding sections 13, 13*a*, 13*b* in the housing 10 of the spacer element 1, and also the blind 8 resting on the free ends 19 of the lateral guiding sections 13*a* and 13*b*, as illustrated in FIG. 9.

The box 9 of the blind 8 is then supported by the lateral guiding sections 13*a*, 13*b* irrespective of the shape and dimensions of its end portions 20, which must only ensure contact on the free ends 19.

The elastic assembly between the spacer element 1 and the guiding sections 13, 13*a*, 13*b* allows small relative movements without for this reason jeopardising the sealing of the assembly over time, unlike what occurs with a conventional assembly carried out with adhesive means.

Moreover, the presence of the guiding sections 13, 13*a*, 13*b* limits the compression of the spacer element 1 during the assembly of the sheets of glass 3, 5, and moreover protects the integrity of the slats of the blind 8, or of the screen or other similar element installed inside the double glazing system 6.

As can be gathered from the description, the invention thus conceived makes it possible to obtain important technical advantages.

Firstly, the spacer element 1 of the double glazing system 6 according to the invention makes it possible to obtain all the advantages that can be achieved with conventional "warm edge" system, in terms of reduction of emission to the outside and therefore of energy saving, together with the possibility of fixing, in a simple, rapid, safe and cost-effective manner, any type of blind, screen or the like, of the type already available on the market, inside the double glazing system.

The noise produced by the rubbing of the slats of the blind 8 along the elements themselves, is also drastically reduced in the systems which mount spacer elements made from aluminium.

Moreover, the formation of dust is reduced, caused in fact by the aforementioned annoying rubbing, which occurs in systems which mount spacer elements made from aluminium.

It is also moreover possible for there to be differentiated dilation of the various components without the risk of separation and without jeopardising the functionality of the spacer element 1.

In another embodiment of the invention not represented in the figures, the guiding sections 13, 13*a*, 13*b* can be made with the respective "T"-shaped portions 14 no longer continuous for the entire length of the sections themselves, but rather discontinuous.

In other words, in the guiding sections 13, 13*a*, 13*b* the "T"-shaped portions 14 can be removed for some parts, for example regularly spaced apart, so as to make the insertion of the portions 14 themselves in the housing of the spacer element 1 easier.

In greater detail, the "T"-shaped portions 14 can be removed substantially at the two opposite rounded ends— visible for example in FIG. 2—i.e. so as to leave, in any case, a portion of wall preventing the light from filtering between the guiding sections 13, 13*a*, 13*b* and the spacer element 1.

It has thus been seen how the invention achieves the aforementioned purposes.

The present invention has been described according to preferred embodiments, however equivalent variants can be conceived without for this reason departing from the scope of protection offered by the following claims.

The invention claimed is:

1. A double glazing system, comprising a first sheet of glass;

a second sheet of glass;

a spacer element comprising a first surface for coupling with the first sheet of glass and a second surface for coupling with the second sheet of glass;

a blind or a screen;

said spacer element being made from low thermally conductive material comprising rubber or silicone foam;

said spacer element comprising support means, inside the double glazing system, for said blind or screen;

said support means comprising a housing made of a substantially "T"-shaped groove made in a surface perpendicular to said first surface and to said second surface, wherein said support means comprise two lateral sections for guiding said blind or screen having respective substantially "T"-shaped portions and being able to be engaged in said housing, said lateral guiding sections comprising respective free ends for supporting respective end portions of said blind or screen.

2. The double glazing system according to claim 1, wherein said low thermally conductive material comprises rubber or silicone foam.

3. The double glazing system according to claim 1, wherein said housing comprises rounded edges.

4. The double glazing system according to claim 1, wherein each of said guiding sections is substantially "L"-shaped.

5. The double glazing system according to claim 1, wherein each of said guiding sections is made from rigid material.

6. The double glazing system according to claim 1, wherein said spacer element comprises a multi-layer barrier for stopping vapour from passing, which covers the outer surface of the element.

7. The double glazing system according to claim 1, wherein said spacer element comprises lateral recesses for mounting sealing gaskets.

8. The double glazing system according to claim 1, wherein said spacer element comprises drying substances including salts incorporated inside it.

9. The double glazing system according to claim 1, wherein said support means comprise upper and lower guiding sections having respective substantially "T"-shaped portions and being able to be engaged in said housing of said spacer element.

10. A method for assembling a double glazing system comprising the steps of:

providing a first sheet of glass and a second sheet of glass;

providing a blind or a screen;

providing a spacer element comprising a first surface for coupling with the first sheet of glass and a second surface for coupling with the second sheet of glass;

providing support means, inside the double glazing system, for said blind or screen, said support means comprising a housing made of a substantially "T"-shaped groove made in a surface perpendicular to said first surface and to said second surface, said support means comprise two lateral sections for guiding said blind or screen having respective substantially "T"-shaped portions; and engaging in said housing, said lateral guiding sections comprising respective free ends for supporting respective end portions of said blind or screen.

11. The method of claim 10, further comprising the steps of:

fixing the spacer element to the first sheet of glass;

inserting the "T"-shaped portions of guiding sections in the housing of said spacer element;

mounting the blind, so that the end portions rest on the free ends of said guiding sections; and fixing the second sheet of glass to said spacer element.

* * * * *